US011512907B2

(12) United States Patent
Tong

(10) Patent No.: US 11,512,907 B2
(45) Date of Patent: Nov. 29, 2022

(54) HEAT EXCHANGE TUBE AND HEAT EXCHANGER HAVING THE SAME

(71) Applicant: SANHUA (HANGZHOU) MICRO CHANNEL HEAT EXCHANGER CO., LTD., Hangzhou (CN)

(72) Inventor: Zhongyao Tong, Beijing (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 261 days.

(21) Appl. No.: 17/090,416

(22) Filed: Nov. 5, 2020

(65) Prior Publication Data

US 2021/0131748 A1 May 6, 2021

(30) Foreign Application Priority Data

Nov. 5, 2019 (CN) ..... 201921894956.5

(51) Int. Cl.

| | |
|---|---|
| ***F28F 1/02*** | (2006.01) |
| ***F28F 1/00*** | (2006.01) |
| ***F28F 1/04*** | (2006.01) |
| ***F28D 1/03*** | (2006.01) |

(52) U.S. Cl.

CPC ..... *F28F 1/022* (2013.01); *F28D 1/0358* (2013.01); *F28D 1/0391* (2013.01); *F28F 1/003* (2013.01); *F28F 1/04* (2013.01)

(58) Field of Classification Search

CPC ..... F28D 1/0358; F28D 1/0391; F28F 1/02; F28F 1/022; F28F 1/003; F28F 1/04

See application file for complete search history.

(56) References Cited

U.S. PATENT DOCUMENTS

| | | | | |
|---|---|---|---|---|
| 4,570,700 | A * | 2/1986 | Ohara | F28F 1/02 165/170 |
| 5,931,226 | A * | 8/1999 | Hirano | B21B 1/227 165/170 |
| 7,152,671 | B2 * | 12/2006 | Shibagaki | F28D 9/0031 165/172 |
| 2006/0243429 | A1 * | 11/2006 | Chu | F28F 3/025 165/177 |
| 2019/0186324 | A1 * | 6/2019 | Greber | F01N 13/1838 |

* cited by examiner

*Primary Examiner* — Devon Russell

(74) *Attorney, Agent, or Firm* — Perkins Coie LLP

(57) ABSTRACT

A heat exchange tube and a heat exchanger are provided. A tube wall of the heat exchange tube includes a first wall and a second wall, a first segment of the first wall includes one of a first groove or a first protrusion, a second segment of the first wall includes one of a second groove or a second protrusion, a first segment of the second wall includes the other one of the first groove or the first protrusion, the first protrusion is arranged in the first groove, the second segment of the second wall includes the other one of the second groove or the second protrusion, and the second protrusion is arranged in the second groove. At least part of each of the first segment and the second segment of the first wall is arranged between the first segment and the second segment of the second wall.

20 Claims, 4 Drawing Sheets

HEAT EXCHANGE TUBE AND HEAT EXCHANGER HAVING THE SAME

CROSS-REFERENCE TO RELATED APPLICATION

This application claims priority to and benefits of Chinese Patent Application No. 201921894956.5, filed with the National Intellectual Property Administration of the People's Republic of China on Nov. 5, 2019. The entire content of the aforementioned patent application is incorporated by reference as part of this patent document for all purposes.

TECHNICAL FIELD

The present disclosure relates to a field of heat exchange technologies, and more particularly to a heat exchange tube and a heat exchanger having the same.

BACKGROUND

A flat tube is a key component of a micro-channel heat exchanger. Typically, the flat tube of a micro-channel heat exchanger includes a folded flat tube that is formed through being folded firstly and then brazed along with the heat exchanger. The folded flat tube may be brazed after a long time. However, the flat tube is made of an aluminum sheet that tends to cause an outer wall of the folded flat tube to be rebounded outward due to material characteristics of the aluminum sheet. Moreover, a spacer is provided in the flat tube to space adjacent channels apart from each other, while the spacer also tends to cause the outer wall of the flat tube to be rebounded outward, thus affecting a brazing quality.

SUMMARY

A heat exchange tube according to embodiments of a first aspect of the present disclosure includes a first side surface, a second side surface, a third side surface, and a fourth side surface, the first side surface and the second side surface are arranged opposite to each other in a first direction, the third side surface and the fourth side surface are arranged opposite to each other in a second direction, and a distance between the first side surface and the second side surface is less than a distance between the third side surface and the fourth side surface. The heat exchange tube includes a plurality of channels and a tube wall, and the tube wall includes a first wall and a second wall. The first wall is folded from a same sheet and includes a first segment of the first wall, a first bent part, a first intermediate segment, a first connecting segment, a second intermediate segment, a second bent part, and a second segment of the first wall. The first segment of the first wall is connected to the first intermediate segment through the first bent part, the second segment of the first wall is connected to the second intermediate segment through the second bent part, the first intermediate segment is spaced apart from the second intermediate segment in the first direction, the first intermediate segment has two side surfaces opposite to each other in the first direction, the first side surface of the heat exchange tube includes one of the two side surfaces of the first intermediate segment positioned away from the second intermediate segment, the second intermediate segment has two side surfaces opposite to each other in the first direction, the second side surface of the heat exchange tube includes one of the two side surfaces of the second intermediate segment positioned away from the first intermediate segment, the first segment of the first wall is spaced apart from the first connecting segment in the second direction, the second segment of the first wall is spaced apart from the first connecting segment in the second direction, the first segment of the first wall includes one of a first groove or a first protrusion, and the second segment of the first wall includes one of a second groove or a second protrusion. The second wall is folded from another same sheet and includes a first segment of the second wall, a second connecting segment, and a second segment of the second wall. The second connecting segment is spaced apart from the first connecting segment in the second direction, the first segment of the second wall is spaced apart from the second segment of the second wall in the first direction, the first segment of the second wall includes the other one of the first groove or the first protrusion, at least part of the first protrusion is arranged in the first groove, the first segment of the first wall is connected to the first segment of the second wall, the second segment of the second wall includes the other one of the second groove or the second protrusion, at least part of the second protrusion is arranged in the second groove, and the second segment of the first wall is connected to the second segment of the second wall. At least part of the first segment of the first wall is arranged between the first segment of the second wall and the second segment of the second wall in the first direction, and at least part of the second segment of the first wall is arranged between the first segment of the second wall and the second segment of the second wall in the first direction.

In the heat exchange tube, according to embodiments of the present disclosure, the tube wall includes the first wall and the second wall connected through the protrusion and the groove, and a part of each segment of the first wall is arranged between at least part of the first segment of the second wall and at least part of the second segment of the second wall, such that the first wall of the heat exchange tube is prevented from being rebounded outward before the first wall and the second wall are brazed.

A heat exchanger according to embodiments of a second aspect of the present disclosure includes: a first header; a second header spaced apart from the first header, and a plurality of heat exchange tubes. At least one of the plurality of heat exchange tubes has a first end and a second end in a length direction thereof. The first end is connected to the first header and the second end is connected to the second header to communicate the first header with the second header. The heat exchange tube includes a first side surface, a second side surface, a third side surface, and a fourth side surface, the first side surface and the second side surface are arranged opposite to each other in a first direction, the third side surface and the fourth side surface are arranged opposite to each other in a second direction, and a distance between the first side surface and the second side surface is less than a distance between the third side surface and the fourth side surface. The heat exchange tube includes a plurality of channels and a tube wall, and the tube wall includes a first wall and a second wall. The first wall is folded from a same sheet and includes a first segment of the first wall, a first bent part, a first intermediate segment, a first connecting segment, a second intermediate segment, a second bent part, and a second segment of the first wall. The first segment of the first wall is connected to the first intermediate segment through the first bent part, the second segment of the first wall is connected to the second intermediate segment through the second bent part, the first intermediate segment is spaced apart from the second intermediate segment in the first direction, the first intermediate segment has two side surfaces opposite to each other in the first direction, the first side surface of the heat exchange tube includes one of the two side surfaces of the first intermediate segment positioned away from the second intermediate segment, the second intermediate segment has two side surfaces opposite to each other in the first direction, the second side surface of the heat exchange tube includes one of the two side surfaces of the second intermediate segment positioned away from the first intermediate segment, the first segment of the first wall is spaced apart from the first connecting segment in the second direction, the second segment of the first wall is spaced apart from the first connecting segment in the second direction, the first segment of the first wall includes one of a first groove or a first protrusion, and the second segment of the first wall includes one of a second groove or a second protrusion. The second wall is folded from another same sheet and includes a first segment of the second wall, a second connecting segment, and a second segment of the second wall. The second connecting segment is spaced apart from the first connecting segment in the second direction, the first segment of the second wall is spaced apart from the second segment of the second wall in the first direction, the first segment of the second wall includes the other one of the first groove or the first protrusion, at least part of the first protrusion is arranged in the first groove, the first segment of the first wall is connected to the first segment of the second wall, the second segment of the second wall includes the other one of the second groove or the second protrusion, at least part of the second protrusion is arranged in the second groove, and the second segment of the first wall is connected to the second segment of the second wall. At least part of the first segment of the first wall is arranged between the first segment of the second wall and the second segment of the second wall in the first direction, and at least part of the second segment of the first wall is arranged between the first segment of the second wall and the second segment of the second wall in the first direction.

A heat exchanger according to embodiments of the present disclosure includes: a heat exchange tube, where the heat exchange tube comprises a plurality of channels and a tube wall. The tube wall has a structure that includes a first wall and a second wall. The first wall is folded from a same sheet and comprises: a first segment of the first wall, a first bent part, a first intermediate segment, a first connecting segment, a second intermediate segment, a second bent part and a second segment of the first wall, the first segment of the first wall being connected to the first intermediate segment through the first bent part, the second segment of the first wall being connected to the second intermediate segment through the second bent part, the first intermediate segment being spaced apart from the second intermediate segment in the first direction, the first intermediate segment having two side surfaces opposite to each other in the first direction, the first side surface of the heat exchange tube comprising one of the two side surfaces of the first intermediate segment away from the second intermediate segment, the second intermediate segment has two side surfaces opposite to each other in the first direction, the second side surface of the heat exchange tube comprising one of the two side surfaces of the second intermediate segment away from the first intermediate segment, the first segment of the first wall being spaced apart from the first connecting segment in the second direction, the second segment of the first wall being spaced apart from the first connecting segment in the second direction, the first segment of the first wall comprising one of a first groove or a first protrusion, the second segment of the first wall comprising one of a second groove or a second protrusion. The second wall is folded from another same sheet and comprises: a first segment of the second wall, a second connecting segment and a second segment of the second wall, the second connecting segment being spaced apart from the first connecting segment in the second direction, the first segment of the second wall being spaced apart from the second segment of the second wall in the first direction, the first segment of the second wall comprising the other one of the first groove or the first protrusion, at least part of the first protrusion being arranged in the first groove, the first segment of the first wall being connected to the first segment of the second wall, the second segment of the second wall comprising the other one of the second groove or the second protrusion, at least part of the second protrusion being arranged in the second groove, and the second segment of the first wall being connected to the second segment of the second wall. For the heat exchange tube, at least part of the first segment of the first wall is arranged between the first segment of the second wall and the second segment of the second wall in the first direction, and at least part of the second segment of the first wall is arranged between the first segment of the second wall and the second segment of the second wall in the first direction.

DETAILED DESCRIPTION

Figure 1:
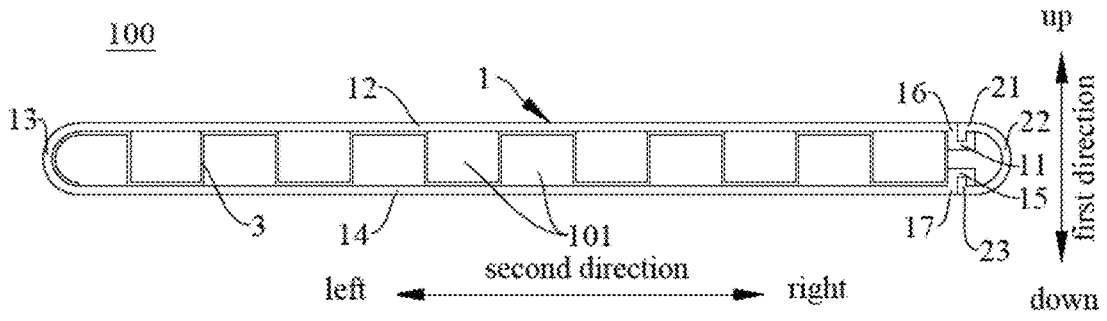
FIG. 1 is a schematic view of a heat exchange tube according to an embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. In the specification, it should be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radially," "circumferential," etc., should be construed to refer to the orientation as then described or as illustrated in the drawings under discussion. These relative terms are for convenience of description and do not require that the present disclosure be construed or operated in a particular orientation, so it is not to be construed as a limit to the present disclosure.

As illustrated in FIGS. 1 to 20, a heat exchange tube 100 according to embodiments of the present disclosure includes a first side surface and a second side surface opposite to each other in a first direction, and further includes a third side surface and a fourth side surface opposite to each other in a second direction. A distance between the first side surface and the second side surface is less than a distance between the third side surface and the fourth side surface. As illustrated in FIGS. 1 to 20, the first direction is an up-down direction, and the second direction is a left-right direction. The heat exchange tube 100 includes an upper side surface and a lower side surface opposite to each other and a left side surface and a right side surface opposite to each other, and a distance between the upper side surface and the lower side surface of the heat exchange tube 100 is less than a distance between the left side surface and the right side surface of the heat exchange tube 100; that is, a thickness of the heat exchange tube 100 is less than a width of the heat exchange tube 100.

Figure 2:
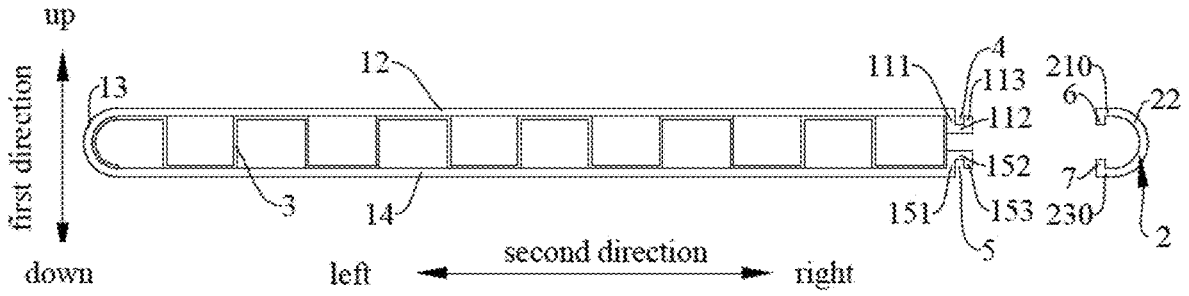
FIG. 2 is an exploded view of the heat exchange tube of FIG. 1.

The first direction is a thickness direction of the heat exchange tube 100, for example, the up-down direction as illustrated in FIGS. 1 and 2. The second direction is a width direction of the heat exchange tube 100, for example, the left-right direction as illustrated in FIGS. 1 and 2.

The heat exchange tube 100 includes a plurality of channels 101. Specifically, the heat exchange tube 100 further includes a first member 3 disposed in the heat exchange tube 100 and configured to space two adjacent channels 101 apart from each other. Specifically, the channel 101 extends along a third direction that is perpendicular to the first direction and the second direction, a length of the channel 101 is equal to a length of the heat exchange tube 100, and the third direction is a length direction of the heat exchange tube 100, for example, a direction perpendicular to the sheet of FIGS. 1 and 2.

The heat exchange tube 100 includes a tube wall, and the tube wall includes a first wall 1 and a second wall 2. The first wall 1 is folded from a same sheet and includes a first segment 11 of the first wall 1, a first bent part 16, a first intermediate segment 12, a first connecting segment 13, a second intermediate segment 14, a second bent part 17, and a second segment 15 of the first wall 1. The first segment 11 of the first wall 1 is connected to the first intermediate segment 12 through the first bent part 16, and the second segment 15 of the first wall 1 is connected to the second intermediate segment 14 through the second bent part 17.

The first intermediate segment 12 and the second intermediate segment 14 are spaced apart from each other in the first direction. The first intermediate segment 12 includes two side surfaces arranged opposite to each other in the first direction, and the first side surface of the heat exchange tube 100 includes one of the two side surfaces of the first intermediate segment 12 away from the second intermediate segment 14. The second intermediate segment 14 includes two side surfaces arranged opposite to each other in the first direction, and the second side surface of the heat exchange tube 100 includes one of the two side surfaces of the second intermediate segment 14 away from the first intermediate segment 12.

As illustrated in FIGS. 1 to 20, the first intermediate segment 12 and the second intermediate segment 14 are spaced apart from each other in the up-down direction, the first intermediate segment 12 includes an upper side surface and a lower side surface, the upper side surface of the first intermediate segment 12 is farther away from the second intermediate segment 14 than the lower side surface, and the upper side surface of the heat exchange tube 100 includes the upper side surface of the first intermediate segment 12. The second intermediate segment 14 includes an upper side surface and a lower side surface, the lower side surface of the second intermediate segment 14 is farther away from the first intermediate segment 12 than the upper side surface of the second intermediate segment 14, and the lower side surface of the heat exchange tube 100 includes the lower side surface of the second intermediate segment 14. The sheet forming the first wall 1 is bent downward at a right end of the first intermediate segment 12 to form the first bent part 16, and is bent upward at a right end of the second intermediate segment 14 to form the second bent part 17.

The first segment 11 of the first wall 1 is spaced apart from the first connecting segment 13 in the second direction, and the second segment 15 of the first wall 1 is spaced apart from the first connecting segment 13 in the second direction. As illustrated in FIGS. 1 to 20, the first segment 11 of the first wall 1 is spaced apart from the first connecting segment 13 by the first intermediate segment 12 in the left-right direction, and the second segment 15 of the first wall 1 is spaced apart from the first connecting segment 13 by the second intermediate segment 14 in the left-right direction. Specifically, the first intermediate segment 12 and the second intermediate segment 14 are spaced by the first member 3 in the up-down direction, and the first member 3 is folded from a same sheet and includes a plurality of first segments and a plurality of second segments. The first segment of the first member 3 extends along the left-right direction and the second segment of the first member 3 extends along the up-down direction. Upper side surfaces of a part of the plurality of first segments of the first member 3 are in contact with the lower side surface of the first intermediate segment 12, and lower side surfaces of another part of the plurality of first segments of the first member 3 are in contact with the upper side surface of the second intermediate segment 14. The second segment of the first member 3 extending along the up-down direction spaces the two adjacent channels 101 from each other.

The first segment 11 of the first wall 1 includes one of a first groove 4 or a first protrusion 6, and the second segment 15 of the first wall 1 includes one of a second groove 5 or a second protrusion 7.

The second wall 2 is folded from another same sheet and includes a first segment 21 of the second wall, a second connecting segment 22 and a second segment 23 of the second wall. The second connecting segment 22 is spaced apart from the first connecting segment 13 in the second direction, and the first segment 21 of the second wall 2 is spaced apart from the second segment 23 of the second wall 2 in the first direction.

As illustrated in FIGS. 1 to 20, the second connecting segment 22 and the first connecting segment 13 are spaced apart from each other in the left-right direction, and the first segment 21 of the second wall 2 and the second segment 23 of the second wall 2 are spaced apart from each other in the up-down direction.

The first segment 21 of the second wall 2 includes the other one of the first groove 4 or the first protrusion 6. In other words, when the first segment 11 of the first wall 1 includes the first groove 4, the first segment 21 of the second wall 2 includes the first protrusion 6, as illustrated in FIGS. 1 to 16; when the first segment 11 of the first wall 1 includes the first protrusion 6, the first segment 21 of the second wall 2 includes the first groove 4, as illustrated in FIGS. 17 to 20. At least a part of the first protrusion 6 is arranged in the first groove 4, and the first segment 11 of the first wall 1 is connected to the first segment 21 of the second wall.

The second segment 23 of the second wall 2 includes the other one of the second groove 5 or the second protrusion 7. In other words, when the second segment 15 of the first wall 1 includes the second groove 5, the second segment 23 of the second wall 2 includes the second protrusion 7, as illustrated in FIGS. 1 to 16; when the second segment 15 of the first wall 1 includes the second protrusion 7, the second segment 23 of the second wall 2 includes the second groove 5, as illustrated in FIGS. 17 to 20. At least part of the second protrusion 7 is arranged in the second groove 5, and the second segment 15 of the first wall 1 is connected to the second segment 23 of the second wall.

At least a part of the first segment 11 of the first wall 1 is located between the first segment 21 of the second wall 2 and the second segment 23 of the second wall 2 in the first direction, and at least a part of the second segment 15 of the first wall 1 is located between the first segment 21 of the second wall 2 and the second segment 23 of the second wall 2 in the first direction. In other words, at least parts of the first segment 11 of the first wall 1 and the second segment 15 of the first wall 1 are both located between the first segment 21 of the second wall and the second segment 23 of the second wall.

In the heat exchange tube 100, according to embodiments of the present disclosure, the tube wall of the heat exchange tube 100 includes the first wall 1 and the second wall 2, the first segment 11 of the first wall includes one of the first groove 4 and the first protrusion 6, the first segment 21 of the second wall includes the other one of the first groove 4 and the first protrusion 6, at least a part of the first protrusion 6 is fitted in the first groove 4, the first segment 11 of the first wall is connected to the first segment 21 of the second wall, the second segment 15 of the first wall includes one of the second groove 5 and the second protrusion 7, the second segment 23 of the second wall includes the other one of the second groove 5 and the second protrusion 7, at least a part of the second protrusion 7 is fitted in the second groove 5, the second segment 15 of the first wall is connected to the second segment 23 of the second wall, and at least parts of the first segment 11 of the first wall and the second segment 15 of the first wall are both located between the first segment 21 of the second wall and the second segment 23 of the second wall. In other words, at least parts of the first segment 11 of the first wall and the second segment 15 of the first wall are both clamped between the first segment 21 of the second wall and the second segment 23 of the second wall. Thus, the first segment 11 of the first wall of the heat exchange tube 100 can be prevented from being rebounded outward before the first segment 11 of the first wall and the first segment 21 of the second wall are brazed, and the second segment 15 of the first wall can be prevented from being rebounded outward before the second segment 15 of the first wall and the second segment 23 of the second wall are brazed.

In some embodiments, the first segment 11 of the first wall includes the first groove 4, the first segment 21 of the second wall includes the first protrusion 6, at least a part of the first protrusion 6 of the first segment 21 of the second wall is arranged in the first groove 4 of the first segment 11 of the first wall, and the first protrusion 6 of the first segment 21 of the second wall is connected to the first segment 11 of the first wall. In other words, the first protrusion 6 of the first segment 21 of the second wall is connected to a bottom surface and a side surface of the first groove 4 of the first segment 11 of the first wall.

The second segment 15 of the first wall includes the second groove 5, the second segment 23 of the second wall includes the second protrusion 7, at least a part of the second protrusion 7 of the second segment 23 of the second wall is arranged in the second groove 5 of the second segment 15 of the first wall, and the second protrusion 7 of the second segment 23 of the second wall is connected to the second segment 15 of the first wall. In other words, the second protrusion 7 of the second segment 23 of the second wall is connected to a bottom surface and a side surface of the second groove 5 of the second segment 15 of the first wall.

A part of the first segment 11 of the first wall is located between the first protrusion 6 of the first segment 21 of the second wall and the second protrusion 7 of the second segment 23 of the second wall in the first direction, and a part of the second segment 15 of the first wall is located between the first protrusion 6 of the first segment 21 of the second wall and the second protrusion 7 of the second segment 23 of the second wall in the first direction. As illustrated in FIGS. 1 to 16, a part of the first segment 11 of the first wall and a part of the second segment 11 of the first wall are located between the first protrusion 6 of the first segment 21 of the second wall and the second protrusion 7 of the second segment 23 of the second wall in the up-down direction.

As illustrated in FIGS. 1 to 16, the first segment 21 of the second wall includes the first protrusion 6 protruding downward, and the second segment 23 of the second wall includes the second protrusion 7 protruding upward.

In some specific embodiments, the first protrusion 6 of the first segment 21 of the second wall includes a first portion 61 and a second portion 62, and the first portion 61 of the first protrusion 6 is connected to one end of the second connecting segment 22, and generally extends in a direction toward the second segment 23 of the second wall. The second portion 62 of the first protrusion 6 is connected to one end of the first portion 61 of the first protrusion 6 away from the second connecting segment 22, and extends generally along the second direction.

The second protrusion 7 of the second segment 23 of the second wall includes a third portion 71 and a fourth portion 72, and the third portion 71 of the second protrusion 7 is connected to the other end of the second connecting segment 22, and generally extends in a direction toward the first segment 21 of the second wall. The fourth portion 72 of the second protrusion 7 is connected to one end of the third portion 71 of the second protrusion 7 away from the second connecting segment 22, and extends generally along the second direction.

A part of the first segment 11 of the first wall and a part of the second segment 15 of the first wall are located between the second portion 62 of the first protrusion 6 of the first segment 21 of the second wall and the fourth portion 72 of the second protrusion 7 of the second segment 23 of the second wall in the first direction.

As illustrated in FIGS. 11 to 14, the first portion 61 of the first protrusion 6 of the first segment 21 of the second wall extends downward, the second portion 62 extends rightward from a lower end of the first portion 61, and the second portion 62 is spaced apart from the first intermediate segment 12 in the up-down direction and the left-right direction. The third portion 71 of the second protrusion 7 of the second segment 23 of the second wall extends upward, and the fourth portion 72 extends rightward from an upper end of the third portion 71; that is, the upper end of the third portion 71 is connected to a left end of the fourth portion 72, and the fourth portion 72 is spaced apart from the second intermediate segment 14 in the up-down direction and the left-right direction.

The second connecting segment 22 is connected to the first portion 61 of the first protrusion 6 of the first segment 21 of the second wall and the third portion 71 of the second protrusion 7 of the second segment 23 of the second wall. A part of the first segment 11 of the first wall and a part of the second segment 15 of the first wall are located between the second portion 62 of the first protrusion 6 of the first segment 21 of the second wall and the fourth portion 72 of the second protrusion 7 of the second segment 23 of the second wall in the up-down direction.

Figure 11:
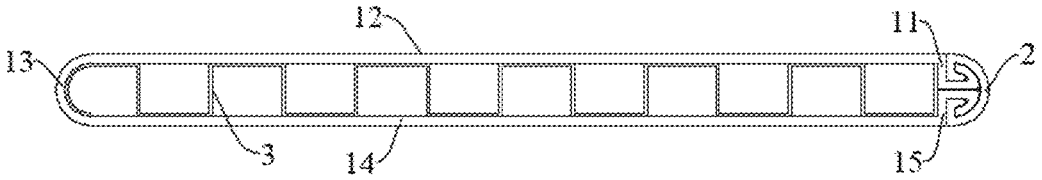
FIG. 11 is a schematic view of a heat exchange tube according to another embodiment of the present disclosure.
Figure 12:
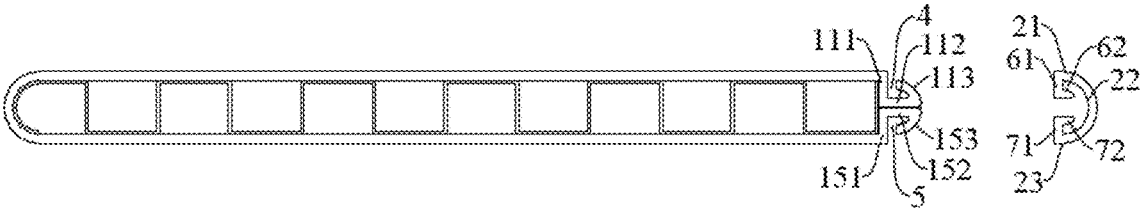
FIG. 12 is an exploded view of the heat exchange tube of FIG. 11.

In the embodiment illustrated in FIGS. 11 and 12, the first segment 11 of the first wall includes a first sub-segment 111, a second sub-segment 112, and a third sub-segment 113, the first sub-segment 111 of the first segment of the first wall extends downward from a right end of the first intermediate segment 12, the second sub-segment 112 of the first segment of the first wall extends rightward from the first sub-segment 111 of the first segment of the first wall, and the third sub-segment 113 of the first segment of the first wall extends upward and leftward into an arc shape from a right end of the second sub-segment 112 of the first segment of the first wall. The first groove 4 is formed by the first sub-segment 111 of the first segment of the first wall, the second sub-segment 112 of the first segment of the first wall, and the third sub-segment 113 of the first segment of the first wall.

The second segment 15 of the first wall includes a fourth sub-segment 151, a fifth sub-segment 152, and a sixth sub-segment 153, the fourth sub-segment 151 of the second segment of the first wall extends upward from a right end of the second intermediate segment 14, the fifth sub-segment 152 of the second segment of the first wall extends rightward from an upward end of the fourth sub-segment 151 of the second segment of the first wall, and the sixth sub-segment 153 of the second segment of the first wall extends downward and leftward into an arc shape from a right end of the fifth sub-segment 152 of the second segment of the first wall. The second groove 5 is formed by the fourth sub-segment 151 of the second segment of the first wall, the fifth sub-segment 152 of the second segment of the first wall, and the sixth sub-segment 153 of the second segment of the first wall.

The second connecting segment 22 is an arc segment, an upper end of the second connecting segment 22 is provided with the first portion 61 extending downward, and the second portion 62 extends rightward from the lower end of the first portion 61. The first portion 61 and the second portion 62 are fitted in the first groove 4 formed by the first sub-segment 111 of the first segment of the first wall, the second sub-segment 112 of the first segment of the first wall, and the third sub-segment 113 of the first segment of the first wall. The upper end of the second connecting segment 22 is connected to the right end of the first intermediate segment 12, the first portion 61 is connected to the first sub-segment 111 of the first segment of the first wall, the second portion 62 is connected to the second sub-segment 112 of the first segment of the first wall, and a part of a surface of the second portion 62 is fitted and connected with an inner side surface of the third sub-segment 113 of the first segment of the first wall.

A lower end of the second connecting segment 22 is provided with the third portion 71, and the fourth portion 72 extends rightward from the upper end of the third portion 71. The third portion 71 and the fourth portion 72 are fitted in the second groove 5 formed by the fourth sub-segment 151 of the second segment of the first wall, the fifth sub-segment 152 of the second segment of the first wall, and the sixth sub-segment 153 of the second segment of the first wall. The lower end of the second connecting segment 22 is fixedly connected to the right end of the second intermediate segment 14, the third portion 71 is connected to the fourth sub-segment 151 of the second segment of the first wall, the fourth portion 72 is connected to the fifth sub-segment 152 of the second segment of the first wall, and a part of a surface of the fourth portion 72 is fitted and connected with an inner side surface of the sixth sub-segment 153 of the second segment of the first wall.

The second sub-segment 112 of the first segment of the first wall and the fifth sub-segment 152 of the second segment of the first wall are located between the second portion 62 and the fourth portion 72 in the up-down direction.

Figure 13:
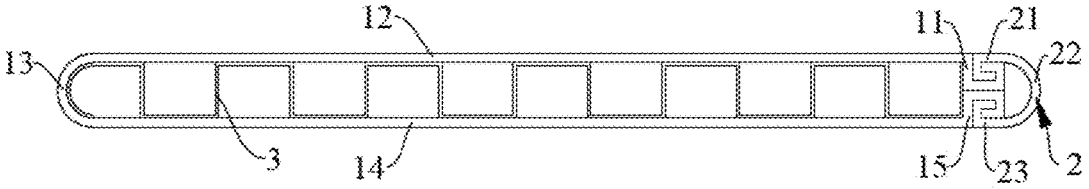
FIG. 13 is a schematic view of a heat exchange tube according to another embodiment of the present disclosure.
Figure 14:
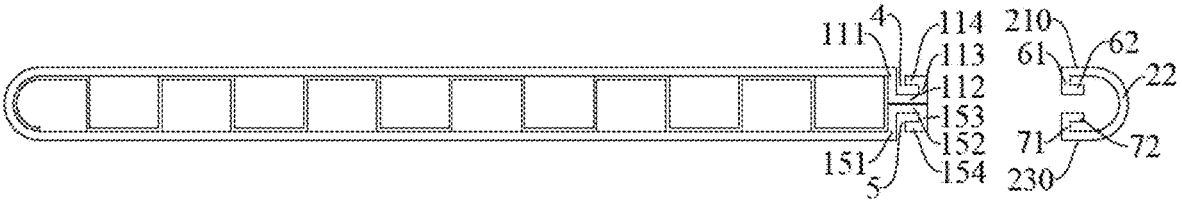
FIG. 14 is an exploded view of the heat exchange tube of FIG. 13.

In the embodiment illustrated in FIGS. 13 and 14, the first segment 11 of the first wall includes a first sub-segment 111, a second sub-segment 112, a third sub-segment 113, and a seventh sub-segment 114, the first sub-segment 111 of the first segment of the first wall extends downward from the right end of the first intermediate segment 12, the second sub-segment 112 of the first segment of the first wall extends rightward from the first sub-segment 111 of the first segment of the first wall, the third sub-segment 113 of the first segment of the first wall extends upward from a right end of the second sub-segment 112 of the first segment of the first wall, and the seventh sub-segment 114 of the first segment of the first wall extends leftward from an upper end of the third sub-segment 113 of the first segment of the first wall and is spaced apart from the first sub-segment 111 of the first segment of the first wall in the left-right direction. The first groove 4 is formed by the first sub-segment 111 of the first segment of the first wall, the second sub-segment 112 of the first segment of the first wall, the third sub-segment 113 of the first segment of the first wall, and the seventh sub-segment 114 of the first segment of the first wall.

The second segment 15 of the first wall includes a fourth sub-segment 151, a fifth sub-segment 152, a sixth sub-segment 153, and an eighth sub-segment 154, the fourth sub-segment 151 of the second segment of the first wall extends upward from the right end of the second intermediate segment 14, the fifth sub-segment 152 of the second segment of the first wall extends rightward from the fourth sub-segment 151 of the second segment of the first wall, the sixth sub-segment 153 of the second segment of the first wall extends downward from a right end of the fifth sub-segment 152 of the second segment of the first wall, and the eighth sub-segment 154 of the second segment of the first wall extends leftward from a lower end of the sixth sub-segment 153 of the second segment of the first wall and is spaced apart from the fourth sub-segment 151 of the second segment of the first wall in the left-right direction. The second groove 5 is formed by the fourth sub-segment 151, the fifth sub-segment 152, the sixth sub-segment 153, and the eighth sub-segment 154 of the second segment of the first wall.

The second connecting segment 22 is an arc segment. The first segment 21 of the second wall further includes a third connecting segment 210, a left end of the third connecting segment 210 is provided with the first portion 61 extending downward, and the second portion 62 extends rightward from a lower end of the first portion 61. The first portion 61 and the second portion 62 are fitted in the first groove 4 formed by the first sub-segment 111 of the first segment of the first wall, the second sub-segment 112 of the first segment of the first wall, the third sub-segment 113 of the first segment of the first wall, and the seventh segment 114 of the first segment of the first wall. The left end of the third connecting segment 210 is connected to the right end of the first intermediate segment 12, the first portion 61 is connected to the first sub-segment 111 of the first segment of the first wall, and the second portion 62 is connected to the second sub-segment 112 of the first segment of the first wall, the third sub-segment 113 of the first segment of the first wall, and the seventh sub-segment 114 of the first segment of the first wall.

The second segment 23 of the second wall further includes a fourth connecting segment 230, a left end of the fourth connecting segment 230 is provided with the third portion 71 extending upward, and the fourth portion 72 extends rightward from an upper end of the third portion 71. The third portion 71 and the fourth portion 72 are fitted in the second groove 5 formed by the fourth sub-segment 151, the fifth sub-segment 152, the sixth sub-segment 153, and the eighth segment 154 of the second segment of the first wall. The left end of the fourth connecting segment 230 is connected to the right end of the second intermediate segment 14, the third portion 71 is connected to the fourth sub-segment 151 of the second segment of the first wall, and the fourth portion 72 is connected to the fifth sub-segment 152 of the second segment of the first wall, the sixth sub-segment 153 of the second segment of the first wall, and the eighth sub-segment 154 of the second segment of the first wall.

The second connecting segment 22 is an arc segment and is connected to a right end of the third connecting segment 210 and a right end of the fourth connecting segment 230.

The second sub-segment 112 of the first segment of the first wall and the fifth sub-segment 152 of the second segment of the first wall are located between the second portion 62 and the fourth portion 72 in the up-down direction.

In the embodiment illustrated in FIGS. 11 and 12 as well as in the embodiment illustrated in FIGS. 13 and 14, the first segment 11 of the first wall and the second segment 15 of the first wall are located at two ends of the same sheet forming the first wall 1, respectively.

In some embodiments, the first segment 21 of the second wall includes the third connecting segment 210 connected to the first intermediate segment 12, and the second segment 23 of the second wall includes the fourth connecting segment 230 connected to the second intermediate segment 14. The second connecting segment 22 is connected to the third connecting segment 210 and the fourth connecting segment 230. The first protrusion 6 is provided to (e.g., included as part or coupled to) one of two opposite side surfaces of the third connecting segment 210 adjacent to the fourth connecting segment 230 in the first direction, and the second protrusion 7 is provided (e.g., included as part or coupled to) to one of two opposite side surfaces of the fourth connecting segment 230 adjacent to the third connecting segment 210 in the first direction.

As illustrated in FIGS. 1 to 10, 13, and 14, the first segment 21 of the second wall includes the third connecting segment 210, the left end of the third connecting segment 210 is connected to the right end of the first intermediate segment 12, and the first protrusion 6 is arranged to a lower side surface of the left end of the third connecting segment 210. The second segment 23 of the second wall includes the fourth connecting segment 230, the left end of the fourth connecting segment 230 is connected to the right end of the second intermediate segment 14, and the second protrusion 7 is arranged to an upper side surface of the left end of the fourth connecting segment 230.

In some specific embodiments, the third connecting segment 210 is generally flush with the first intermediate segment 12 in the second direction, and the fourth connecting segment 230 is generally flush with the second intermediate segment 14 in the second direction. The first side surface of the heat exchange tube 100 further includes the other one of the two opposite side surfaces of the third connecting segment 210 away from the fourth connecting segment 230 in the first direction, and the second side surface of the heat exchange tube 100 further includes the other one of the two opposite side surfaces of the fourth connecting segment 230 away from the third connecting segment 210 in the first direction.

As illustrated in FIGS. 1 to 10, 13, and 14, the third connecting segment 210 includes an upper side surface and a lower side surface opposite to each other, and the upper side surface of the third connecting segment 210 is farther away from the fourth connecting segment 230 than the lower side surface of the third connecting segment 210. The upper side surface of the third connecting segment 210 is generally flush with the upper side surface of the first intermediate segment 12 in the left-right direction. The upper side surface of the heat exchange tube 100 includes the upper side surface of the third connecting segment 210 and the upper side surface of the first intermediate segment 12. Further, the lower side surface of the third connecting segment 210 is also generally flush with the lower side surface of the first intermediate segment 12 in the left-right direction.

The fourth connecting segment 230 includes an upper side surface and a lower side surface opposite to each other, and the lower side surface of the fourth connecting segment 230 is farther away from the third connecting segment 210 than the upper side surface of the fourth connecting segment 230. The upper side surface of the fourth connecting segment 230 is generally flush with the upper side surface of the second intermediate segment 14 in the left-right direction, and the lower side surface of the fourth connecting segment 230 is also generally flush with the lower side surface of the second intermediate segment 14 in the left-right direction. The lower side surface of the heat exchange tube 100 includes the lower side surface of the fourth connecting segment 230 and the lower side surface of the second intermediate segment 14.

In some embodiments, the first segment 11 of the first wall includes the first sub-segment 111, the second sub-segment 112, and the third sub-segment 113, the second sub-segment 112 of the first segment of the first wall is connected to the first sub-segment 111 of the first segment of the first wall and the third sub-segment 113 of the first segment of the first wall, and the first sub-segment 111 of the first segment of the first wall extends toward the second intermediate segment 14 from a side surface of the first intermediate segment 12 adjacent to the second intermediate segment 14 in the first direction. The first sub-segment 111 of the first segment of the first wall is spaced apart from the third sub-segment 113 of the first segment of the first wall in the second direction, and the third sub-segment 113 of the first segment of the first wall is located at a side of the second sub-segment 112 of the first segment of the first wall away from the second segment 15 of the first wall.

The second segment 15 of the first wall includes the fourth sub-segment 151, the fifth sub-segment 152, and the sixth sub-segment 153, the fifth sub-segment 152 of the second segment of the first wall is connected to the fourth sub-segment 151 of the second segment of the first wall and the sixth sub-segment 153 of the second segment of the first wall, and the fourth sub-segment 151 of the second segment of the first wall extends from toward the first intermediate segment 12 from a side surface of the second intermediate segment 14 adjacent to the first intermediate segment 12 in the first direction. The fourth sub-segment 151 of the second segment of the first wall is spaced apart from the sixth sub-segment 153 of the second segment of the first wall in the second direction, and the sixth sub-segment 153 of the second segment of the first wall is located at a side of the fifth sub-segment 152 of the second segment of the first wall away from the first segment 11 of the first wall.

The second sub-segment 112 of the first segment of the first wall and the fifth sub-segment 152 of the second segment of the first wall are arranged between the first protrusion 6 of the first segment 21 of the second wall and the second protrusion 7 of the second segment 23 of the second wall.

As illustrated in FIGS. 1 to 4, the first segment 11 of the first wall includes the first sub-segment 111, the second sub-segment 112, and the third sub-segment 113, the first sub-segment 111 of the first segment of the first wall extends downward from the right end of the first intermediate segment 12, the second sub-segment 112 of the first segment of the first wall extends rightward from the first sub-segment 111 of the first segment of the first wall, and the third sub-segment 113 of the first segment of the first wall extends upward from the right end of the second sub-segment 112 of the first segment of the first wall. The first groove 4 is formed by the first sub-segment 111 of the first segment of the first wall, the second sub-segment 112 of the first segment of the first wall, and the third sub-segment 113 of the first segment of the first wall.

The second segment 15 of the first wall includes the fourth sub-segment 151, the fifth sub-segment 152, and the sixth sub-segment 153, the fourth sub-segment 151 of the second segment of the first wall extends upward from the right end of the second intermediate segment 14, the fifth sub-segment 152 of the second segment of the first wall extends rightward from the upper end of the fourth sub-segment 151 of the second segment of the first wall, and the sixth sub-segment 153 of the second segment of the first wall extends downward from the right end of the fifth sub-segment 152 of the second segment of the first wall. The second groove 5 is formed by the fourth sub-segment 151 of the second segment of the first wall, the fifth sub-segment 152 of the second segment of the first wall, and the sixth sub-segment 153 of the second segment of the first wall.

The second sub-segment 112 of the first segment 11 of the first wall and the fifth sub-segment 152 of the second segment 15 of the first wall are located between the first protrusion 6 of the first segment 21 of the second wall and the second protrusion 7 of the second segment 23 of the second wall in the up-down direction.

In the embodiment illustrated in FIGS. 1 and 2, the first protrusion 6 of the first segment 21 of the second wall extends downward, has a substantially square shape, and is fitted in the first groove 4. The second protrusion 7 of the second segment 23 of the second wall extends upward, has a substantially square shape, and is fitted in the second groove 5.

Figure 3:
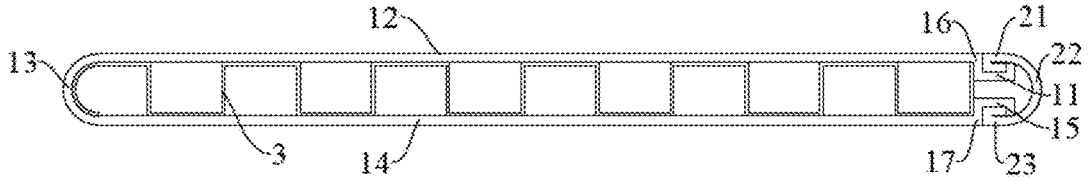
FIG. 3 is a schematic view of a heat exchange tube according to another embodiment of the present disclosure.
Figure 4:
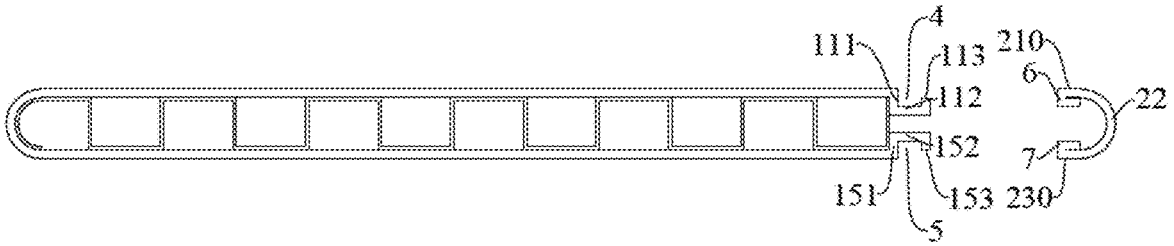
FIG. 4 is an exploded view of the heat exchange tube of FIG. 3.
Figure 5:
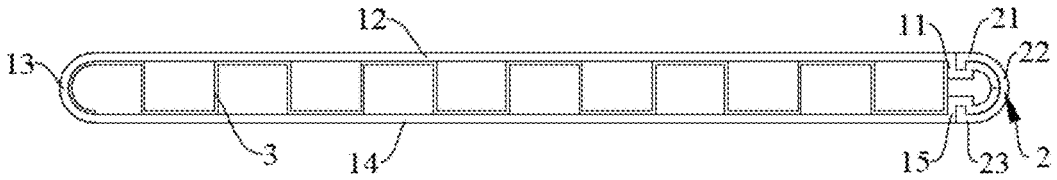
FIG. 5 is a schematic view of a heat exchange tube according to another embodiment of the present disclosure.
Figure 6:
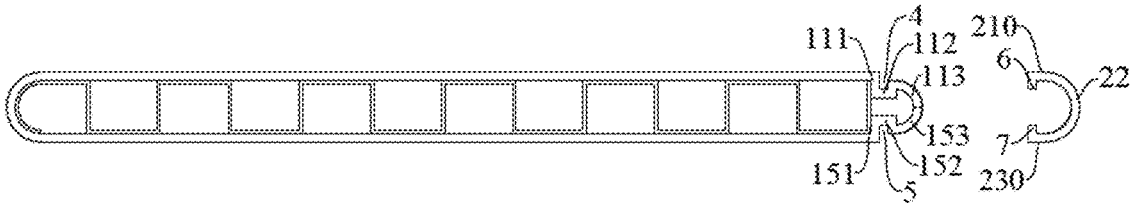
FIG. 6 is an exploded view of the heat exchange tube of FIG. 5.

In the embodiments illustrated in FIGS. 3 and 4, the first protrusion 6 of the first segment 21 of the second wall and the third connecting segment 210 both extend along the left-right direction, and a left end of the first protrusion 6 of the first segment 21 of the second wall is connected to the left end of the third connecting segment 210. The second protrusion 7 of the second segment 23 of the second wall and the fourth connecting segment 230 both extend along the left-right direction, and a left end of the second protrusion 7 of the second segment 23 of the second wall is connected to the left end of the fourth connecting segment 230.

In the present disclosure, the third sub-segment 113 of the first segment of the first wall is not limited to the above embodiments. For example, in the embodiments illustrated in FIGS. 5 to 8, the third sub-segment 113 of the first segment of the first wall has an arc shape and extends rightward and downward from an upper side surface of the right end of the second sub-segment 112 of the first segment of the first wall. The third sub-segment 113 of the first segment of the first wall is fitted with a portion or part of an inner side surface of the second connecting segment 22. The first groove 4 is formed by a left end of the third sub-segment 113 of the first segment of the first wall, the second sub-segment 112 of the first segment of the first wall and the first sub-segment 111 of the first segment of the first wall.

The sixth sub-segment 153 of the second segment of the first wall has an arc shape and extends rightward and upward from a lower side surface of the right end of the fifth sub-segment 152 of the second segment of the first wall. The sixth sub-segment 153 of the second segment of the first wall is fitted with at least part of the rest of the inner side surface of the second connecting segment 22. The second groove 5 is formed by a left end of the sixth sub-segment 153 of the second segment of the first wall, the fifth sub-segment 152 of the second segment of the first wall, and the fourth sub-segment 151 of the second segment of the first wall.

Figure 9:
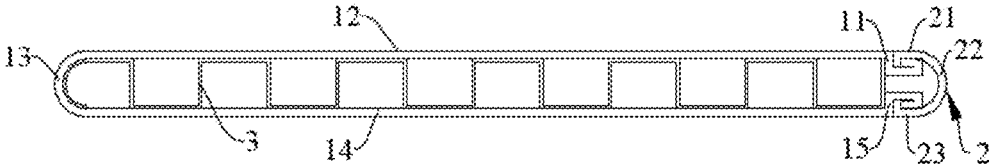
FIG. 9 is a schematic view of a heat exchange tube according to another embodiment of the present disclosure.
Figure 10:
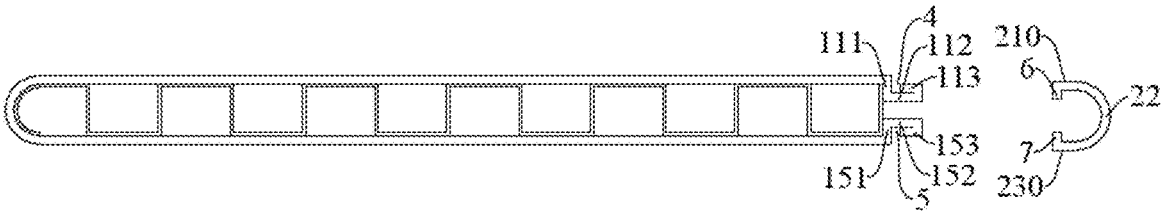
FIG. 10 is an exploded view of the heat exchange tube of FIG. 9.

Further, for example, in the embodiment illustrated in FIGS. 9 and 10, the third sub-segment 113 of the first segment of the first wall is generally parallel to the second sub-segment 112 of the first segment of the first wall, and a right end of the third sub-segment 113 of the first segment of the first wall is connected to the right end of the second sub-segment 112 of the first segment of the first wall. The first groove 4 is formed by the first sub-segment 111 of the first segment of the first wall, the second sub-segment 112 of the first segment of the first wall, and the third sub-segment 113 of the first segment of the first wall. The first protrusion 6 extends downward, has a substantially square shape, and is fitted in the first groove 4.

The sixth sub-segment 153 of the second segment of the first wall is generally parallel to the fifth sub-segment 152 of the second segment of the first wall, and a right end of the sixth sub-segment 153 of the second segment of the first wall is connected to the right end of the fifth sub-segment 152 of the second segment of the first wall. The second groove 5 is formed by the fourth sub-segment 151 of the second segment of the first wall, the fifth sub-segment 152 of the second segment of the first wall, and the sixth sub-segment 153 of the second segment of the first wall. The second protrusion 7 extends upward, has a substantially square shape, and is fitted in the second groove 5.

In some embodiments, at least part of the third sub-segment 113 of the first segment of the first wall is in contact with part of the first segment 21 of the second wall and/or part of the second connecting segment 22.

At least part of the sixth sub-segment 153 of the second segment of the first wall is in contact with part of the second segment 23 of the second wall and/or part of the second connecting segment 22.

As illustrated in FIGS. 1 and 2, the upper end of the third sub-segment 113 of the first segment of the first wall is in contact with the lower side surface of the third connecting segment 210 of the first segment 21 of the second wall, and the lower end of the sixth sub-segment 153 of the second segment of the first wall is in contact with the upper side surface of the fourth connecting segment 230 of the second segment 23 of the second wall.

As illustrated in FIGS. 3 and 4, the upper end of the third sub-segment 113 of the first segment of the first wall is in contact with a junction of the third connecting segment 210 and the second connecting segment 22, and the lower end of the sixth sub-segment 153 of the second segment of the first wall is in contact with a junction of the fourth connecting segment 230 and the second connecting segment 22.

As illustrated in FIGS. 5 to 8, an outer side surface of the third sub-segment 113 of the first segment of the first wall is in contact with a part of the lower side surface of the third connecting segment 210 and a part of the inner side surface of the second connecting segment 22. An outer side surface of the sixth sub-segment 153 of the second segment of the first wall is in contact with a part of the upper side surface of the fourth connecting segment 230 and at least part of the rest of the inner side surface of the second connecting segment 22.

As illustrated in FIGS. 9 and 10, the outer side surface of the third sub-segment 113 of the first segment of the first wall is in contact with a part of the lower side surface of the third connecting segment 210 and the junction of the third connecting segment 210 and the second connecting segment 22. The outer side surface of the sixth sub-segment 153 of the second segment of the first wall is in contact with a part of the upper side surface of the fourth connecting segment 230 and the junction of the fourth connecting segment 230 and the second connecting segment 22.

In some embodiments, the first protrusion 6 of the first segment 21 of the second wall and the first intermediate segment 12 are spaced in the first direction, and the second protrusion 7 of the second segment 23 of the second wall and the second intermediate segment 14 are spaced in the first direction.

Figure 15:
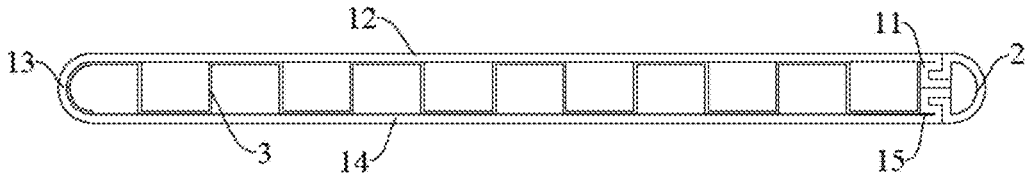
FIG. 15 is a schematic view of a heat exchange tube according to another embodiment of the present disclosure.
Figure 16:
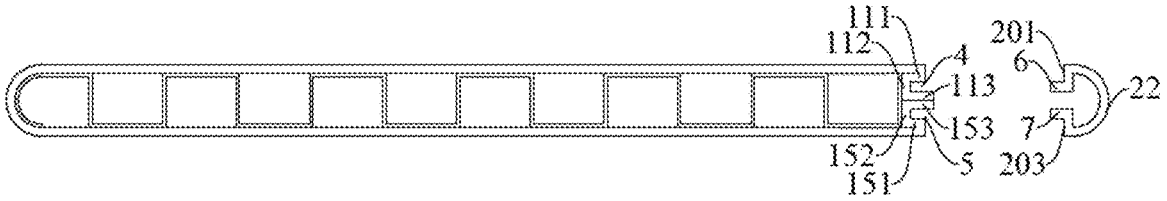
FIG. 16 is an exploded view of the heat exchange tube of FIG. 15.

As illustrated in FIGS. 15 and 16, the first protrusion 6 of the first segment 21 of the second wall is spaced apart from the first intermediate segment 12 in the up-down direction, and the second protrusion 7 of the second segment 23 of the second wall is spaced apart from the second intermediate segment 14 in the up-down direction.

The first segment 21 of the second wall includes a first base segment 201 extending along the up-down direction, an upper end of the first base segment 201 is connected to the inner side surface of the upper end of the second connecting segment 22, and a left side surface of a lower end of the first base segment 201 is provided with the first protrusion 6 protruding leftward.

The second segment 23 of the second wall further includes a second base segment 203 extending along the up-down direction, a lower end of the second base segment 203 is connected to the inner side surface of the lower end of the second connecting segment 22, and a left side surface of an upper end of the second base segment 203 is provided with the second protrusion 7 protruding leftward.

In some specific embodiments, the first segment 11 of the first wall includes the first sub-segment 111, the second sub-segment 112, and the third sub-segment 113, and the second sub-segment 112 of the first segment of the first wall is connected to the first sub-segment 111 of the first segment of the first wall and the third sub-segment 113 of the first segment of the first wall. The first sub-segment 111 of the first segment of the first wall is arranged side-by-side with the first intermediate segment 12 in the first direction and is located at the side of the first intermediate segment 12 adjacent to the second intermediate segment 14 in the first direction. The first sub-segment 111 of the first segment 11 of the first wall is spaced apart from the third sub-segment 113 of the first segment 11 of the first wall in the first direction, and the third sub-segment 113 of the first segment 11 of the first wall is located at an end of the second sub-segment 112 of the first segment 11 of the first wall adjacent to the second segment 15 of the first wall.

The second segment 15 of the first wall includes the fourth sub-segment 151, the fifth sub-segment 152, and the sixth sub-segment 153, and the fifth sub-segment 152 of the second segment of the first wall is connected to the fourth sub-segment 151 of the second segment of the first wall and the sixth sub-segment 153 of the second segment of the first wall. The fourth sub-segment 151 of the second segment of the first wall is arranged side-by-side with the second intermediate segment 14 in the first direction and is located at a side of the second intermediate segment 14 adjacent to the first intermediate segment 12 in the first direction. The fourth sub-segment 151 of the second segment of the first wall is spaced apart from the sixth sub-segment 153 of the second segment of the first wall in the first direction, and the sixth sub-segment 153 of the second segment of the first wall is located at an end of the sixth sub-segment 152 of the second segment of the first wall adjacent to the first segment 11 of the first wall.

The third sub-segment of the first segment 11 of the first wall and the sixth sub-segment of the second segment 15 of the first wall are arranged between the first protrusion 6 of the first segment 21 of the second wall and the second protrusion 7 of the second segment 23 of the second wall.

As illustrated in FIGS. 15 and 16, the first segment 11 of the first wall includes the first sub-segment 111, the second sub-segment 112, and the third sub-segment 113, the first sub-segment 111 of the first segment of the first wall is arranged side-by side with the right end of the first intermediate segment 12 along a direction from bottom to top, and the right end of the first sub-segment 111 of the first segment of the first wall is connected to the right end of the first intermediate segment 12. The second sub-segment 112 of the first segment of the first wall extends downward from the left end of the first sub-segment 111 of the first segment of the first wall, and the third sub-segment 113 of the first segment of the first wall extends rightward from the lower end of the second sub-segment 112 of the first segment of the first wall. The first groove 4 is formed by the first sub-segment 111, the second sub-segment 112, and the third sub-segment 113 of the first segment of the first wall, and the first protrusion 6 is fitted in the first groove 4.

The second segment 15 of the first wall includes the fourth sub-segment 151, the fifth sub-segment 152, and the sixth sub-segment 153, the fourth sub-segment 151 of the second segment of the first wall is arranged side-by-side with the right end of the second intermediate segment 14 along a direction from top to bottom, and the right end of the fourth sub-segment 151 of the second segment of the first wall is connected to the right end of the second intermediate segment 14. The fifth sub-segment 152 of the second segment of the first wall extends upward from the left end of the fourth sub-segment 151 of the second segment of the first wall, and the sixth sub-segment 153 of the second segment of the first wall extends rightward from the upper end of the fifth sub-segment 152 of the second segment of the first wall. The second groove 5 is formed by the fourth sub-segment 151, the fifth sub-segment 152, and the sixth sub-segment 153 of the second segment of the first wall, and the second protrusion 7 is fitted in the second groove 5.

The third sub-segment 113 of the first segment of the first wall is arranged side-by-side with the sixth sub-segment 153 of the second segment of the first wall in the up-down direction. The third sub-segment 113 of the first segment of the first wall and the sixth sub-segment 153 of the second segment of the first wall are clamped between the first protrusion 6 and the second protrusion 7.

It may be understood that the present disclosure is not limited to the above form in which the first wall 1 has the groove and the second wall 2 has the protrusion. For example, in some other embodiments, the first segment 11 of the first wall includes the first protrusion 6, the first segment 21 of the second wall includes the first groove 4, at least part of the first protrusion 6 of the first segment 11 of the first wall is arranged in the first groove 4 of the first segment 21 of the second wall, and the first protrusion 6 of the first segment 11 of the first wall is connected to the first segment 21 of the second wall. The second segment 15 of the first wall includes the second protrusion 7, the second segment 23 of the second wall includes the second groove 5, at least part of the second protrusion 7 of the second segment 15 of the first wall is arranged in the second groove 5 of the second segment 23 of the second wall, and the second protrusion 7 of the second segment 15 of the first wall is connected to the second segment 23 of the second wall. A part of the first protrusion 6 of the first segment 11 of the first wall is located between a part of the first segment 21 of the second wall and a part of the second segment 23 of the second wall in the first direction, and a part of the second protrusion 7 of the second segment 15 of the first wall is located between a part of the first segment 21 of the second wall and a part of the second segment 23 of the second wall in the first direction.

As illustrated in FIGS. 17 to 20, the first segment 11 of the first wall includes the first protrusion 6 protruding downward, the first protrusion 6 of the first segment 11 of the first wall includes the first portion 61 extending downward from the right end of the first intermediate segment 12, and the second portion 62 extends leftward from the lower end of the first portion 61.

The second segment 15 of the first wall includes the second protrusion 7 protruding upward, the second protrusion 7 of the second segment 15 of the first wall includes the third portion 71 extending upward from the right end of the second intermediate segment 14 and the fourth portion 72 extending leftward from the upper end of the third portion 71.

The second portion 62 of the first protrusion 6 of the first segment 11 of the first wall and the fourth portion 72 of the second protrusion 7 of the second segment 15 of the first wall are both located between a part of the first segment 21 of the second wall and a part of the second segment 23 of the second wall in the first direction.

Figure 19:
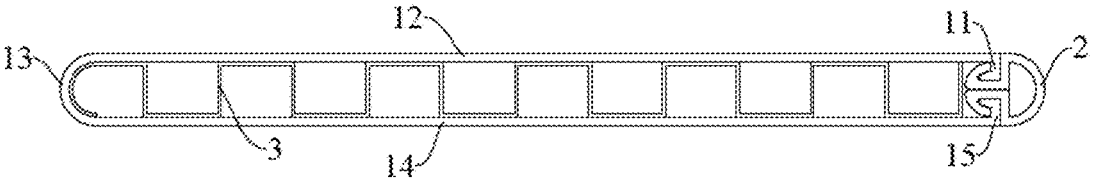
FIG. 19 is a schematic view of a heat exchange tube according to another embodiment of the present disclosure.
Figure 20:
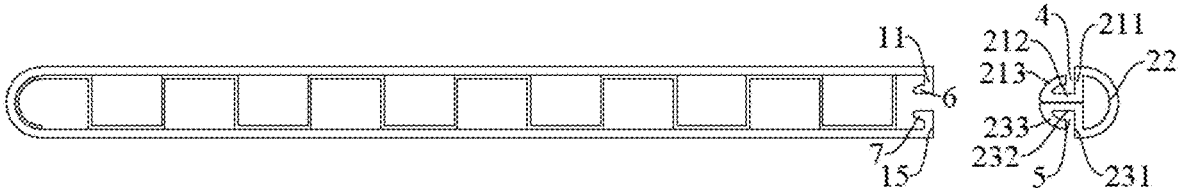
FIG. 20 is an exploded view of the heat exchange tube of FIG. 19.

In the embodiment illustrated in FIGS. 19 and 20, the first segment 21 of the second wall includes a first sub-segment 211, a second sub-segment 212, and a third sub-segment 213, the first sub-segment 211 of the first segment of the second wall extends downward from the upper end of the second connecting segment 22, the second sub-segment 212 of the first segment of the second wall extends leftward from a lower end of the first sub-segment 211 of the first segment of the second wall, and the third sub-segment 213 of the first segment of the second wall has an arc shape and extends upward and rightward from a left end of the second sub-segment 212 of the first segment of the second wall. The first groove 4 is formed by the first sub-segment 211, the second sub-segment 212, and the third sub-segment 213 of the first segment of the second wall. The first portion 61 is in contact with the first sub-segment 211 of the first segment of the second wall and an end of the third sub-segment 213 of the first segment of the second wall away from the second sub-segment 212, and the second portion 62 is in contact with an inner side surface of the third sub-segment 213 of the first segment of the second wall and an upper side surface of the second sub-segment 212 of the first segment of the second wall.

The second segment 23 of the second wall includes a fourth sub-segment 231, a fifth sub-segment 232, and a sixth sub-segment 233, the fourth sub-segment 231 of the second segment of the second wall extends upward from the lower end of the second connecting segment 22, the fifth sub-segment 232 of the second segment of the second wall extends leftward from an upper end of the fourth sub-segment 231 of the second segment of the second wall, and the sixth sub-segment 233 of the second segment of the second wall has an arc shape and extends downward and rightward from a left end of the fifth sub-segment 232 of the second segment of the second wall. The second groove 5 is formed by the fourth sub-segment 231, the fifth sub-segment 232, and the sixth sub-segment 233 of the second segment of the second wall. The third portion 71 is in contact with the fourth sub-segment 231 of the second segment of the second wall and an end of the sixth sub-segment 233 of the second segment of the second wall away from the fifth sub-segment 232, and the fourth portion 72 is in contact with an inner side surface of the sixth sub-segment 233 of the second segment of the second wall and a lower side surface of the fifth sub-segment 232 of the second segment of the second wall.

Figure 17:
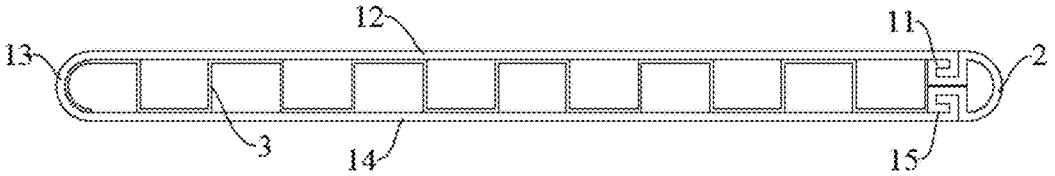
FIG. 17 is a schematic view of a heat exchange tube according to another embodiment of the present disclosure.
Figure 18:
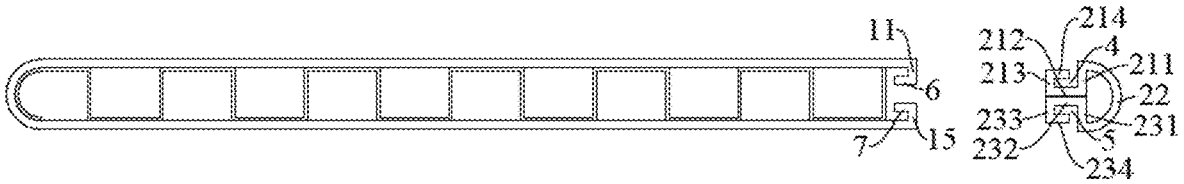
FIG. 18 is an exploded view of the heat exchange tube of FIG. 17.

In the embodiment illustrated in FIGS. 17 and 18, the first segment 21 of the second wall includes the first sub-segment 211, the second sub-segment 212, the third sub-segment 213, and the seventh sub-segment 214, the first sub-segment 211 of the first segment of the second wall extends downward from an upper end of the second connecting segment 22, the second sub-segment 212 of the first segment of the second wall extends leftward from a lower end of the first sub-segment 211 of the first segment of the second wall, the third sub-segment 213 of the first segment of the second wall extends upward from a left end of the second sub-segment 212 of the first segment of the second wall, and the seventh sub-segment 214 of the first segment of the second wall extends rightward from an upper end of the third sub-segment 213 of the first segment of the second wall and is spaced apart from the first sub-segment 211 of the first segment of the second wall in the left-right direction. The first groove 4 is formed by the first sub-segment 211, the second sub-segment 212, the third sub-segment 213, and the seventh sub-segment 214 of the first segment of the second wall. The first portion 61 is in contact with the first sub-segment 211 of the first segment of the second wall and an end of the seventh sub-segment 214 of the first segment of the second wall away from the third sub-segment 213, and the second portion 62 is in contact with a right side surface of the third sub-segment 213 of the first segment of the second wall, a lower side surface of the seventh sub-segment 214 of the first segment of the second wall, and an upper side surface of the second sub-segment 212 of the first segment of the second wall.

The second segment 23 of the second wall includes the fourth sub-segment 231, the fifth sub-segment 232, the sixth sub-segment 233, and the eighth sub-segment 234, the fourth sub-segment 231 of the second segment of the second wall extends upward from a lower end of the second connecting segment 22, the fifth sub-segment 232 of the second segment of the second wall extends leftward from an upper end of the fourth sub-segment 231 of the second segment of the second wall, the sixth sub-segment 233 of the second segment of the second wall extends downward from a left end of the fifth sub-segment 232 of the second segment of the second wall, and the eighth sub-segment 234 of the second segment of the second wall extends rightward from a lower end of the sixth sub-segment 233 of the second segment of the second wall and is spaced apart from the fourth sub-segment 231 of the second segment of the second wall in the left-right direction. The second groove 5 is formed by the fourth sub-segment 231, the fifth sub-segment 232, the sixth sub-segment 233, and the eighth sub-segment 234 of the second segment of the second wall. The third portion 71 is in contact with the fourth sub-segment 231 of the second segment of the second wall and an end of the eighth sub-segment 234 of the second segment of the second wall away from the sixth sub-segment 233, and the fourth portion 72 is in contact with a right side surface of the sixth sub-segment 233 of the second segment of the second wall, an upper side surface of the eighth sub-segment 234 of the second segment of the second wall, and a lower side surface of the fifth sub-segment 232 of the second segment of the second wall.

In some embodiments, the second connecting segment 22 includes a first transitional portion 221, a second transitional portion 222, a third transitional portion 223, and a fourth transitional portion 224, the first transitional portion 221 is connected to the first segment 21 of the second wall, the fourth transitional portion 224 is connected to the second segment 23 of the second wall, the second transitional portion 222 is connected to the first transitional portion 221 and is located at an inner side of the first transitional portion 221, the third transitional portion 223 is connected to the fourth transitional portion 224 and is located at an inner side of the fourth transitional portion 224, and the second transitional portion 222 is arranged side-by-side with the third transitional portion 223 in the first direction. An end of the first segment 11 of the first wall away from the first intermediate segment 12 is in contact with the second transitional portion 222, and an end of the second segment 15 of the first wall away from the second intermediate segment 14 is in contact with the third transitional portion 223.

Figure 7:
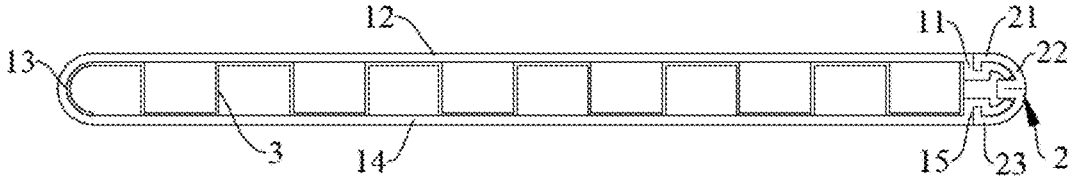
FIG. 7 is a schematic view of a heat exchange tube according to another embodiment of the present disclosure.
Figure 8:
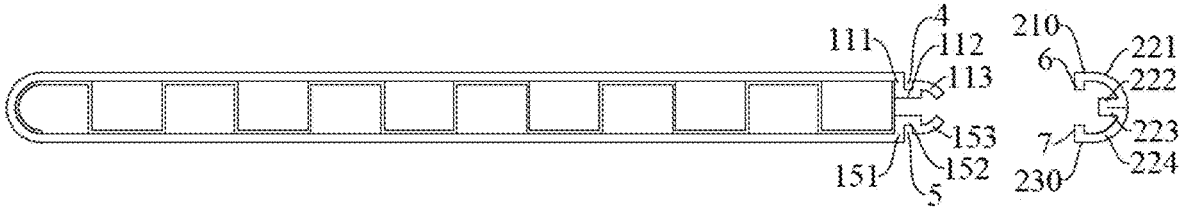
FIG. 8 is an exploded view of the heat exchange tube of FIG. 7.

As illustrated in FIGS. 7 and 8, the first transitional portion 221 and the fourth transitional portion 224 of the second connecting segment 22 are arc segments, the second transitional portion 222 and the third transitional portion 223 of the second connecting segment 22 are straight segments, the first transitional portion 221 is connected to the first segment 21 of the second wall and extends downward and rightward into an arc shape, the second transitional portion 222 extends leftward from an inner side surface of a lower end of the first transitional portion 221, the third transitional portion 223 is arranged side-by-side with the second transitional portion 222 in the up-down direction, a left end of the third transitional portion 223 is connected to a left end of the second transitional portion 222, a right end of the third transitional portion 223 is connected to the fourth transitional portion 224, and the fourth transitional portion 224 extends downward and leftward into an arc shape so as to be connected with the second segment 23 of the second wall.

An end of the third sub-segment 113 of the first segment of the first wall away from the second sub-segment 112 is in contact with an upper side surface of the second transitional portion 222, and an end of the sixth sub-segment 153 of the second segment of the first wall away from the fifth sub-segment 152 is in contact with a lower side surface of the third transitional portion 223.

In some embodiments, the first segment 11 of the first wall is arranged opposite to the second segment 15 of the first wall in the first direction, and the first segment 21 of the second wall is arranged opposite to the second segment 23 of the second wall in the first direction.

As illustrated in FIGS. 1 to 20, the first segment 11 of the first wall is arranged opposite to the second segment 15 of the first wall in the up-down direction, and the first segment 21 of the second wall is arranged opposite to the second segment 23 of the second wall in the up-down direction. It may be understood that the present disclosure is not limited to this. For example, the first segment 11 of the first wall is not arranged opposite to the second segment 15 of the first wall in the up-down direction, and the first segment 21 of the second wall also is not arranged opposite to the second segment 23 of the second wall in the up-down direction.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples. In addition, those skilled in the related art may combine and incorporate different embodiments or examples and their features described in the specification, without mutual contradictions.

In the descriptions, unless specified or limited otherwise, the terms "mounted," "connected," "coupled," and "fixed" and variations thereof should be understood broadly. For example, these may be permanent connections, detachable connections or integrated connections; mechanical connections, electrical connections or communicated with each other; direct connections or indirect connections through intermediaries; intercommunication or interaction relationships of two elements, unless specified or limited otherwise. Those skilled in the related art may understand specific meanings of the above terms in the present disclosure according to specific situations.

In the present disclosure, unless specified or limited otherwise, a structure in which a first feature is "on" or "below" a second feature may include an embodiment in which the first feature is in direct contact with the second feature, and may also include an embodiment in which the first feature is in indirect contact with the second feature through intermediaries. Furthermore, a first feature "on," "above," or "on top of" a second feature may include an embodiment in which the first feature is right "on," "above," or "on top of" the second feature, and may also include an embodiment in which the first feature is diagonally "on," "above," or "on top of" the second feature, which means that the first feature is at a height higher than that of the second feature. A first feature "beneath," "below," or "on bottom of" a second feature may include an embodiment in which the first feature is right "beneath," "below," or "on bottom of" the second feature, and may also include an embodiment in which the first feature is diagonally "beneath," "below," or "on bottom of" the second feature, which means that the first feature is at a height lower than that of the second feature.

Although explanatory embodiments have been illustrated and described, it would be appreciated by those skilled in the art that the above embodiments cannot be construed to limit the present disclosure, and changes, alternatives, and modifications can be made in the embodiments without departing from spirit, principles, and scope of the present disclosure.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described, and other implementations, enhancements, and variations can be made based on what is described and illustrated in this patent document.

What is claimed is:

1. A heat exchange tube, comprising a first side surface, a second side surface, a third side surface and a fourth side surface, the first side surface and the second side surface being arranged opposite to each other in a first direction, the third side surface and the fourth side surface being arranged opposite to each other in a second direction, a distance between the first side surface and the second side surface being less than a distance between the third side surface and the fourth side surface, the heat exchange tube comprising a plurality of channels and a tube wall, the tube wall comprising:

a first wall folded from a same sheet and comprising a first segment of the first wall, a first bent part, a first intermediate segment, a first connecting segment, a second intermediate segment, a second bent part and a second segment of the first wall, the first segment of the first wall being connected to the first intermediate segment through the first bent part, the second segment of the first wall being connected to the second intermediate segment through the second bent part, the first intermediate segment being spaced apart from the second intermediate segment in the first direction, the first intermediate segment having two side surfaces opposite to each other in the first direction, the first side surface of the heat exchange tube comprising one of the two side surfaces of the first intermediate segment away from the second intermediate segment, the second intermediate segment has two side surfaces opposite to each other in the first direction, the second side surface of the heat exchange tube comprising one of the two side surfaces of the second intermediate segment away from the first intermediate segment, the first segment of the first wall being spaced apart from the first connecting segment in the second direction, the second segment of the first wall being spaced apart from the first connecting segment in the second direction, the first segment of the first wall comprising one of a first groove or a first protrusion, the second segment of the first wall comprising one of a second groove or a second protrusion; and a second wall folded from another same sheet and comprising a first segment of the second wall, a second connecting segment and a second segment of the second wall, the second connecting segment being spaced apart from the first connecting segment in the second direction, the first segment of the second wall being spaced apart from the second segment of the second wall in the first direction, the first segment of the second wall comprising the other one of the first groove or the first protrusion, at least part of the first protrusion being arranged in the first groove, the first segment of the first wall being connected to the first segment of the second wall, the second segment of the second wall comprising the other one of the second groove or the second protrusion, at least part of the second protrusion being arranged in the second groove, and the second segment of the first wall being connected to the second segment of the second wall, wherein at least part of the first segment of the first wall is arranged between the first segment of the second wall and the second segment of the second wall in the first direction, and at least part of the second segment of the first wall is arranged between the first segment of the second wall and the second segment of the second wall in the first direction.

2. The heat exchange tube according to claim 1, wherein the first segment of the first wall comprises the first groove, the second segment of the first wall comprises the second groove, the first segment of the second wall comprises the first protrusion, at least part of the first protrusion of the first segment of the second wall is arranged in the first groove of the first segment of the first wall, the first protrusion of the first segment of the second wall is connected to the first segment of the first wall, the second segment of the second wall comprises the second protrusion, at least part of the second protrusion of the second segment of the second wall is arranged in the second groove of the second segment of the first wall, the second protrusion of the second segment of the second wall is connected to the second segment of the first wall, a part of the first segment of the first wall is arranged between the first protrusion of the first segment of the second wall and the second protrusion of the second segment of the second wall in the first direction, and a part of the second segment of the first wall is arranged between the first protrusion of the first segment of the second wall and the second protrusion of the second segment of the second wall in the first direction.

3. The heat exchange tube according to claim 2, wherein the first protrusion of the first segment of the second wall comprises a first portion and a second portion, the first portion of the first protrusion is connected to an end of the second connecting segment and extends generally in a direction toward the second segment of the second wall, the second portion of the first protrusion is connected to an end of the first portion of the first protrusion away from the second connecting segment and extends generally along the second direction, the second protrusion of the second segment of the second wall comprises a third portion and a fourth portion, the third portion of the second protrusion is connected to another end of the second connecting segment and extends in a direction toward the first segment of the second wall, the fourth portion of the second protrusion is connected to an end of the third portion of the second protrusion away from the second connecting segment and extends generally along the second direction, a part of the first segment of the first wall and a part of the second segment of the first wall are arranged between the second portion of the first protrusion of the first segment of the second wall and the fourth portion of the second protrusion of the second segment of the second wall in the first direction.

4. The heat exchange tube according to claim 2, wherein the first segment of the second wall comprises a third connecting segment connected to the first intermediate segment, the second segment of the second wall comprises a fourth connecting segment connected to the second intermediate segment, the second connecting segment is connected to the third connecting segment and the fourth connecting segment, the first protrusion is arranged to one of two opposite side surfaces of the third connecting segment adjacent to the fourth connecting segment in the first direction, and the second protrusion is arranged to one of two opposite side surfaces of the fourth connecting segment adjacent to the third connecting segment in the first direction.

5. The heat exchange tube according to claim 4, wherein the third connecting segment is generally flush with the first intermediate segment in the second direction, the fourth connecting segment is generally flush with the second intermediate segment in the second direction, the first side surface of the heat exchange tube further comprises the other one of the two opposite side surfaces of the third connecting segment away from the fourth connecting segment in the first direction, and the second side surface of the heat exchange tube further comprises the other one of the two opposite side surfaces of the fourth connecting segment away from the third connecting segment in the first direction.

6. The heat exchange tube according to claim 4, wherein the first segment of the first wall comprises a first sub-segment, a second sub-segment and a third sub-segment, the second sub-segment of the first segment of the first wall is connected to the first sub-segment of the first segment of the first wall and the third sub-segment of the first segment of the first wall, the first sub-segment of the first segment of the first wall extends toward the second intermediate segment from a side surface of the first intermediate segment adjacent to the second intermediate segment in the first direction, the first sub-segment of the first segment of the first wall is spaced apart from the third sub-segment of the first segment of the first wall in the second direction, the third sub-segment of the first segment of the first wall is arranged at a side of the second sub-segment of the first segment of the first wall away from the second segment of the first wall, the second segment of the first wall comprises a fourth sub-segment, a fifth sub-segment and a sixth sub-segment, the fifth sub-segment of the second segment of the first wall is connected to the fourth sub-segment of the second segment of the first wall and the sixth sub-segment of the second segment of the first wall, the fourth sub-segment of the second segment of the first wall extends toward the first intermediate segment from a side surface of the second intermediate segment adjacent to the first intermediate segment in the first direction, the fourth sub-segment of the second segment of the first wall is spaced apart from the sixth sub-segment of the second segment of the first wall in the second direction, the sixth sub-segment of the second segment of the first wall is arranged at a side of the fifth sub-segment of the second segment of the first wall away from the first segment of the first wall, the second sub-segment of the first segment of the first wall and the fifth sub-segment of the second segment of the first wall are arranged between the first protrusion of the first segment of the second wall and the second protrusion of the second segment of the second wall in the first direction.

7. The heat exchange tube according to claim 6, wherein at least part of the third sub-segment of the first segment of the first wall is in contact with at least one of part of the first segment of the second wall and part of the second connecting segment, at least part of the sixth sub-segment of the second segment of the first wall is in contact with at least one of part of the second segment of the second wall and part of the second connecting segment.

8. The heat exchange tube according to claim 2, wherein the first protrusion of the first segment of the second wall is spaced apart from the first intermediate segment in the first direction, and the second protrusion of the second segment of the second wall is spaced apart from the second intermediate segment in the first direction.

9. The heat exchange tube according to claim 8, wherein the first segment of the first wall comprises a first sub-segment, a second sub-segment and a third sub-segment, the second sub-segment of the first segment of the first wall is connected to the first sub-segment of the first segment of the first wall and the third sub-segment of the first segment of the first wall, the first sub-segment of the first segment of the first wall is arranged side-by-side with the first intermediate segment in the first direction and is arranged at a side of the first intermediate segment adjacent to the second intermediate segment in the first direction, the first sub-segment of the first segment of the first wall is spaced apart from the third sub-segment of the first segment of the first wall in the first direction, the third sub-segment of the first segment of the first wall is arranged at an end of the second sub-segment of the first segment of the first wall adjacent to the second segment of the first wall, the second segment of the first wall comprises a fourth sub-segment, a fifth sub-segment and a sixth sub-segment, the fifth sub-segment of the second segment of the first wall is connected to the fourth sub-segment of the second segment of the first wall and the sixth sub-segment of the second segment of the first wall, the fourth sub-segment of the second segment of the first wall is arranged side-by-side with the second intermediate segment in the first direction and is arranged at a side of the second intermediate segment adjacent to the first intermediate segment in the first direction, the fourth sub-segment of the second segment of the first wall is spaced apart from the sixth sub-segment of the second segment of the first wall in the first direction, the sixth sub-segment of the second segment of the first wall is arranged at an end of the fifth sub-segment of the second segment of the first wall adjacent to the first segment of the first wall, the third sub-segment of the first segment of the first wall and the sixth sub-segment of the second segment of the first wall are arranged between the first protrusion and the second protrusion in the first direction.

10. The heat exchange tube according to claim 1, wherein the first segment of the first wall comprises the first protrusion, the second segment of the first wall comprises the second protrusion, the first segment of the second wall comprises the first groove, at least part of the first protrusion of the first segment of the first wall is arranged in the first groove of the first segment of the second wall, the first protrusion of the first segment of the first wall is connected to the first segment of the second wall, the second segment of the second wall comprises the second groove, at least part of the second protrusion of the second segment of the first wall is arranged in the second groove of the second segment of the second wall, the second protrusion of the second segment of the first wall is connected to the second segment of the second wall, a part of the first protrusion of the first segment of the first wall is arranged between a part of the first segment of the second wall and a part of the second segment of the second wall in the first direction, and a part of the second protrusion of the second segment of the first wall is arranged between a part of the first segment of the second wall and a part of the second segment of the second wall in the first direction.

11. The heat exchange tube according to claim 1, wherein the second connecting segment comprises a first transitional portion, a second transitional portion, a third transitional portion and a fourth transitional portion, the first transitional portion is connected to the first segment of the second wall, the fourth transitional portion is connected to the second segment of the second wall, the second transitional portion is connected to the first transitional portion and is arranged at an inner side of the first transitional portion, the third transitional portion is connected to the fourth transitional portion and is arranged at an inner side of the fourth transitional portion, the second transitional portion is arranged side-by-side with the third transitional portion in the first direction, an end of the first segment of the first wall away from the first intermediate segment is in contact with the second transitional portion, and an end of the second segment of the first wall away from the second intermediate segment is in contact with the third transitional portion.

12. The heat exchange tube according to claim 1, wherein the first segment of the first wall and the second segment of the first wall are arranged opposite to each other in the first direction, the first segment of the second wall and the second segment of the second wall are arranged opposite to each other in the first direction.

13. A heat exchanger, comprising:

a first header;

a second header spaced apart from the first header; and a plurality of heat exchange tubes, at least one of the plurality of heat exchange tubes having a first end and a second end in a length direction thereof, the first end being connected to the first header and the second end being connected to the second header to communicate the first header with the second header, the heat exchange tube comprising a first side surface, a second side surface, a third side surface and a fourth side surface, the first side surface and the second side surface being arranged opposite to each other in a first direction, the third side surface and the fourth side surface being arranged opposite to each other in a second direction, a distance between the first side surface and the second side surface being less than a distance between the third side surface and the fourth side surface, the heat exchange tube comprising a plurality of channels and a tube wall, the tube wall comprising:

a first wall folded from a same sheet and comprising a first segment of the first wall, a first bent part, a first intermediate segment, a first connecting segment, a second intermediate segment, a second bent part and a second segment of the first wall, the first segment of the first wall being connected to the first intermediate segment through the first bent part, the second segment of the first wall being connected to the second intermediate segment through the second bent part, the first intermediate segment being spaced apart from the second intermediate segment in the first direction, the first intermediate segment having two side surfaces opposite to each other in the first direction, the first side surface of the heat exchange tube comprising one of the two side surfaces of the first intermediate segment away from the second intermediate segment, the second intermediate segment has two side surfaces opposite to each other in the first direction, the second side surface of the heat exchange tube comprising one of the two side surfaces of the second intermediate segment away from the first intermediate segment, the first segment of the first wall being spaced apart from the first connecting segment in the second direction, the second segment of the first wall being spaced apart from the first connecting segment in the second direction, the first segment of the first wall comprising one of a first groove or a first protrusion, the second segment of the first wall comprising one of a second groove or a second protrusion; and a second wall folded from another same sheet and comprising a first segment of the second wall, a second connecting segment and a second segment of the second wall, the second connecting segment being spaced apart from the first connecting segment in the second direction, the first segment of the second wall being spaced apart from the second segment of the second wall in the first direction, the first segment of the second wall comprising the other one of the first groove or the first protrusion, at least part of the first protrusion being arranged in the first groove, the first segment of the first wall being connected to the first segment of the second wall, the second segment of the second wall comprising the other one of the second groove or the second protrusion, at least part of the second protrusion being arranged in the second groove, and the second segment of the first wall being connected to the second segment of the second wall, wherein at least part of the first segment of the first wall is arranged between the first segment of the second wall and the second segment of the second wall in the first direction, and at least part of the second segment of the first wall is arranged between the first segment of the second wall and the second segment of the second wall in the first direction.

14. The heat exchanger according to claim 13, wherein the first segment of the first wall comprises the first groove, the second segment of the first wall comprises the second groove, the first segment of the second wall comprises the first protrusion, at least part of the first protrusion of the first segment of the second wall is arranged in the first groove of the first segment of the first wall, the first protrusion of the first segment of the second wall is connected to the first segment of the first wall, the second segment of the second wall comprises the second protrusion, at least part of the second protrusion of the second segment of the second wall is arranged in the second groove of the second segment of the first wall, the second protrusion of the second segment of the second wall is connected to the second segment of the first wall, a part of the first segment of the first wall is arranged between the first protrusion of the first segment of the second wall and the second protrusion of the second segment of the second wall in the first direction, and a part of the second segment of the first wall is arranged between the first protrusion of the first segment of the second wall and the second protrusion of the second segment of the second wall in the first direction.

15. The heat exchanger according to claim 14, wherein the first protrusion of the first segment of the second wall comprises a first portion and a second portion, the first portion of the first protrusion is connected to an end of the second connecting segment and extends generally in a direction toward the second segment of the second wall, the second portion of the first protrusion is connected to an end of the first portion of the first protrusion away from the second connecting segment and extends generally along the second direction, the second protrusion of the second segment of the second wall comprises a third portion and a fourth portion, the third portion of the second protrusion is connected to another end of the second connecting segment and extends in a direction toward the first segment of the second wall, the fourth portion of the second protrusion is connected to an end of the third portion of the second protrusion away from the second connecting segment and extends generally along the second direction, a part of the first segment of the first wall and a part of the second segment of the first wall are arranged between the second portion of the first protrusion of the first segment of the second wall and the fourth portion of the second protrusion of the second segment of the second wall in the first direction.

16. The heat exchanger according to claim 14, wherein the first segment of the second wall comprises a third connecting segment connected to the first intermediate segment, the second segment of the second wall comprises a fourth connecting segment connected to the second intermediate segment, the second connecting segment is connected to the third connecting segment and the fourth connecting segment, the first protrusion is arranged to one of two opposite side surfaces of the third connecting segment adjacent to the fourth connecting segment in the first direction, and the second protrusion is arranged to one of two opposite side surfaces of the fourth connecting segment adjacent to the third connecting segment in the first direction.

17. The heat exchanger according to claim 16, wherein the third connecting segment is generally flush with the first intermediate segment in the second direction, the fourth connecting segment is generally flush with the second intermediate segment in the second direction, the first side surface of the heat exchange tube further comprises the other one of the two opposite side surfaces of the third connecting segment away from the fourth connecting segment in the first direction, and the second side surface of the heat exchange tube further comprises the other one of the two opposite side surfaces of the fourth connecting segment away from the third connecting segment in the first direction.

18. The heat exchanger according to claim 16, wherein the first segment of the first wall comprises a first sub-segment, a second sub-segment and a third sub-segment, the second sub-segment of the first segment of the first wall is connected to the first sub-segment of the first segment of the first wall and the third sub-segment of the first segment of the first wall, the first sub-segment of the first segment of the first wall extends toward the second intermediate segment from a side surface of the first intermediate segment adjacent to the second intermediate segment in the first direction, the first sub-segment of the first segment of the first wall is spaced apart from the third sub-segment of the first segment of the first wall in the second direction, the third sub-segment of the first segment of the first wall is arranged at a side of the second sub-segment of the first segment of the first wall away from the second segment of the first wall, the second segment of the first wall comprises a fourth sub-segment, a fifth sub-segment and a sixth sub-segment, the fifth sub-segment of the second segment of the first wall is connected to the fourth sub-segment of the second segment of the first wall and the sixth sub-segment of the second segment of the first wall, the fourth sub-segment of the second segment of the first wall extends toward the first intermediate segment from a side surface of the second intermediate segment adjacent to the first intermediate segment in the first direction, the fourth sub-segment of the second segment of the first wall is spaced apart from the sixth sub-segment of the second segment of the first wall in the second direction, the sixth sub-segment of the second segment of the first wall is arranged at a side of the fifth sub-segment of the second segment of the first wall away from the first segment of the first wall, the second sub-segment of the first segment of the first wall and the fifth sub-segment of the second segment of the first wall are arranged between the first protrusion of the first segment of the second wall and the second protrusion of the second segment of the second wall in the first direction.

19. The heat exchanger according to claim 18, wherein at least part of the third sub-segment of the first segment of the first wall is in contact with at least one of part of the first segment of the second wall and part of the second connecting segment, at least part of the sixth sub-segment of the second segment of the first wall is in contact with at least one of part of the second segment of the second wall and part of the second connecting segment.

20. The heat exchanger according to claim 14, wherein the first protrusion of the first segment of the second wall is spaced apart from the first intermediate segment in the first direction, and the second protrusion of the second segment of the second wall is spaced apart from the second intermediate segment in the first direction, wherein the first segment of the first wall comprises a first sub-segment, a second sub-segment and a third sub-segment, the second sub-segment of the first segment of the first wall is connected to the first sub-segment of the first segment of the first wall and the third sub-segment of the first segment of the first wall, the first sub-segment of the first segment of the first wall is arranged side-by-side with the first intermediate segment in the first direction and is arranged at a side of the first intermediate segment adjacent to the second intermediate segment in the first direction, the first sub-segment of the first segment of the first wall is spaced apart from the third sub-segment of the first segment of the first wall in the first direction, the third sub-segment of the first segment of the first wall is arranged at an end of the second sub-segment of the first segment of the first wall adjacent to the second segment of the first wall, the second segment of the first wall comprises a fourth sub-segment, a fifth sub-segment and a sixth sub-segment, the fifth sub-segment of the second segment of the first wall is connected to the fourth sub-segment of the second segment of the first wall and the sixth sub-segment of the second segment of the first wall, the fourth sub-segment of the second segment of the first wall is arranged side-by-side with the second intermediate segment in the first direction and is arranged at a side of the second intermediate segment adjacent to the first intermediate segment in the first direction, the fourth sub-segment of the second segment of the first wall is spaced apart from the sixth sub-segment of the second segment of the first wall in the first direction, the sixth sub-segment of the second segment of the first wall is arranged at an end of the fifth sub-segment of the second segment of the first wall adjacent to the first segment of the first wall, the third sub-segment of the first segment of the first wall and the sixth sub-segment of the second segment of the first wall are arranged between the first protrusion and the second protrusion in the first direction.

* * * * *